United States Patent [19]

Seeger

[11] 4,128,744

[45] Dec. 5, 1978

[54] KEYBOARD WITH CONCAVE AND CONVEX DOMES

[75] Inventor: Richard E. Seeger, Topsfield, Mass.

[73] Assignee: Chomerics, Inc., Woburn, Mass.

[21] Appl. No.: 771,016

[22] Filed: Feb. 22, 1977

[51] Int. Cl.[2] ..... H01H 13/70

[52] U.S. Cl. ..... 200/5 A; 200/159 B; 200/292

[58] Field of Search ..... 200/5 R, 5 A, 85 R, 200/86 R, 159 A, 159 B, 264, 275, 292, 302; 74/68.5, 88 R, 36; 361/398

[56] References Cited

U.S. PATENT DOCUMENTS

| | | | |
|---|---|---|---|
| 3,383,487 | 5/1968 | Wiener | 200/302 |
| 3,627,935 | 12/1971 | Spievak | 200/5 A X |
| 3,721,778 | 3/1973 | Seeger, Jr. et al. | 200/5 R |
| 3,789,167 | 1/1974 | Seeger, Jr. et al. | 200/5 A |
| 3,854,018 | 12/1974 | Reynolds et al. | 200/5 A |
| 3,860,771 | 1/1975 | Lynn et al. | 200/5 A |
| 3,862,381 | 1/1975 | Glaister et al. | 200/5 A |
| 3,862,382 | 1/1975 | Glaister et al. | 200/5 A |
| 3,911,234 | 10/1975 | Kotaka | 200/5 A |
| 3,978,297 | 8/1976 | Lynn et al. | 200/86 R X |
| 4,028,509 | 6/1977 | Zurcher | 200/5 A |
| 4,029,916 | 6/1977 | Chu | 200/159 B X |
| 4,032,729 | 6/1977 | Koistinen | 200/5 A |
| 4,066,851 | 1/1978 | White et al. | 200/5 A |
| 4,081,898 | 4/1978 | Taylor, Jr. et al. | 200/5 A X |

FOREIGN PATENT DOCUMENTS

| | | | |
|---|---|---|---|
| 2459464 | 6/1975 | Fed. Rep. of Germany | 200/5 A |

OTHER PUBLICATIONS

J. R. Lester et al., IBM Tech. Disc. Bull., "Switch", vol. 11, No. 11, Apr. 1969, p. 1569

*Primary Examiner*—James R. Scott

*Attorney, Agent, or Firm*—Sewall P. Bronstein; Donald Brown

[57] ABSTRACT

Keyboard device having a top flexible plastic contactor sheet with a first circuit pattern thereon, said first pattern comprising contactors and circuit lines, a bottom sheet having a second circuit pattern comprising contacts and circuit lines, an insulator spacer having openings in register with said contactors, said sheet having formed therein one or a plurality of protrusions or domes which support a portion of the first circuit pattern, and means for continuously urging the one or plurality of protrusions or domes supporting a portion of said first circuit pattern against a portion of said second circuit pattern.

8 Claims, 9 Drawing Figures

KEYBOARD WITH CONCAVE AND CONVEX DOMES

BACKGROUND OF THE INVENTION

This invention is an improvement over the keyboard shown in U.S. Pat. Nos. 3,860,771, or 3,721,778, and others in which pins or a portion of a circuit extend from the top to the bottom of a support in order to make connections between circuit patterns above and below the support.

In this invention the contactor supporting sheet is provided with protrusions or domes which support portions of a circuit pattern. The protrusions are continuously urged by the keyboard frame, adhesive, or both into contact with an underlying circuit pattern.

Applicant would like to cite the following U.S. Pat. Nos.: 3,383,487; 3,991,463; 3,818,279; 3,861,135; 3,680,037; 3,469,016; 3,437,529; 3,557,446; and Great Britain Pat. No. 940,518.

BRIEF DESCRIPTION OF THE PREFERRED FORM OF THE INVENTION

This invention in its most preferred form provides a keyboard in which the top sheet is of an insulator plastic and preferably includes a plurality of oppositely disposed protrusions, each of the protrusions supporting a portion of a circuit pattern on the sheet and some of the protrusions snappable to provide tactile feel and the others continuously being disposed against a circuit pattern supported by an underlying insulator support so that electrical contact may be made at all times between portions of the top and bottom circuit patterns.

DESCRIPTION OF THE DISCLOSURE

Figure 1:
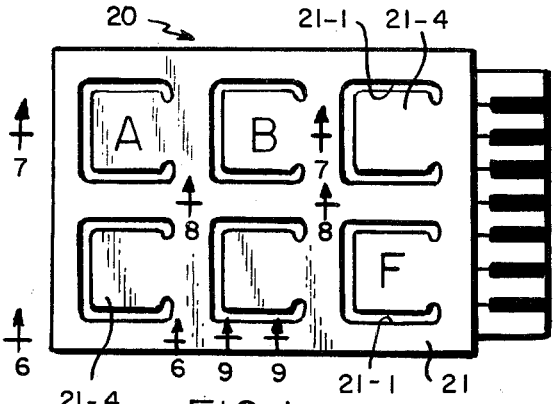
FIG. 1 is a top view of a keyboard assembly of the invention.
Figure 2:
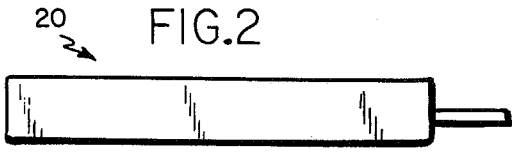
FIG. 2 is a side view of a keyboard assembly of the invention.
Figure 8:
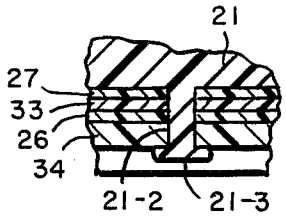
FIG. 8 is a sectional view greatly enlarged taken along line 8—8 in FIG. 1.
Figure 3:
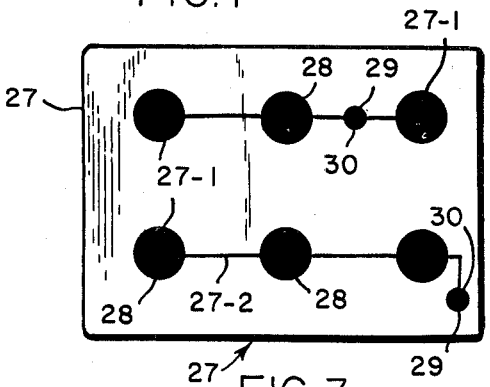
FIG. 3 is a bottom view of a top keyboard sheet according to the invention prior to being placed in a frame.
Figure 4:
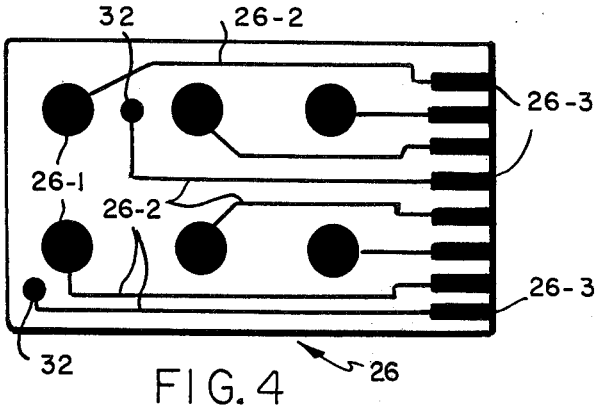
FIG. 4 is a top view of a bottom support sheet.
Figure 5:
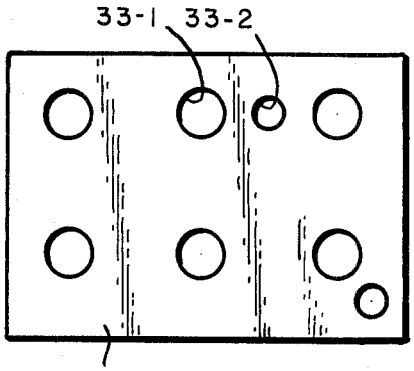
FIG. 5 is a top view of an insulator spacer of the invention.
Figure 6:
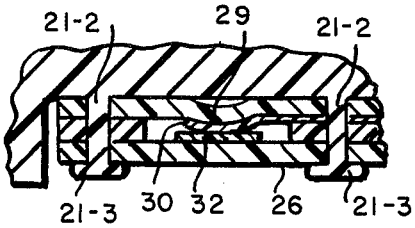
FIG. 6 is a sectional view greatly enlarged taken along line 6—6 in FIG. 1.

Reference should now be had to FIGS. 1 to 9 for a description of the preferred embodiment of the disclosure. At 20 there is shown a keyboard assembly 20 having a frame 21, windows 21-1 and rods 21-2 extending downwardly from the top thereof for holding the operating parts of the assembly compressively together. The frame may be of plastic such as polypropylene, polystyrene, etc. Heads 21-3 may be formed on the bottom of the rods 21-2 by heat or alternatively the rods may be threaded and nuts may be used to hold the operating parts of the assembly forceably together.

Hinged actuators or buttons are shown at 21-4 and form part of the frame. The actuators are bendable to operate the keys such as domes of the keyboard to be described below. Alternatively, actuating buttons such as in the aforementioned U.S. Pat. No. 3,860,771 may be used or others known in the art may be substituted therefor.

The operating parts of the keys comprise a flexible and resilient bottom sheet 26 of insulator plastic material, for example, polyester such as Mylar and others as disclosed in U.S. Pat. No. 3,860,771 or a hard or rigid insulator plastic sheet such as epoxy, and having a circuit pattern comprising contacts 26-1 and circuit lines 26-2 which lead out to terminals 26-3 positioned thereon. The contact lines, contacts and terminals are preferably electrically conductive plastic ink as disclosed in U.S. Pat. No. 3,860,771, or etched copper as disclosed in U.S. Pat. No. 3,860,771, or a combination of both.

At 27 there is provided a top sheet which is positionable over the lower sheet 26 as shown. The top sheet 27 preferably comprises a flexible and resilient plastic for example, polyester such as Mylar, etc., as shown in U.S. Pat. No. 3,860,771.

The top sheet 27 supports a circuit pattern comprising contactors 27-1 and circuit lines 27-2. The contactors 27-1 and circuit lines 27-2 preferably comprise the same type of flexible conductive plastic ink or etched copper as the circuit lines 27-2 and contactors 26-1 as shown in U.S. Pat. No. 3,860,771.

The contactors 27-1 as shown are supported by the underside of convex shaped snappable domes or dimples 28 preferably of the type as disclosed in U.S. Pat. No. 3,860,771. The domes are depressed by the actuators 21-4 to selectively engage contacts 26-1. The sheet 27 portion is also provided with concave protrusions 29 which support connector contacts 30 also forming a portion of the top circuit pattern. These concave protrusions are used to continuously selectively interconnect the underlying circuit contacts 32 on bottom portion 26 with the uppercircuit pattern thereby providing a means for supplying electrical power to the contactors 26-1 of the upper sheet 27.

The protrusions 29 may be formed as disclosed in U.S. Pat. No. 3,860,771, and may be conveniently made from the 5 mil Mylar sheet used as the sheet 27 with a diameter of 62 mils and a depth of about 31 mils.

The connector protrusions 29 having the circuit pattern conductive material with contact 30 supported on the top thereof will, when urged against contacts 32 on the underlying sheet, conduct electricity from the circuit pattern on the bottom sheet 26 to the circuit pattern on top sheet 27.

Positioned between the sheets 26 and 27 is a snap through layer or spacer 33 of non-conductive material, for example, plastic such as Mylar. The spacer 33 has holes 33-1 in register with the domes 28 and the contacts 26-1 and holes 33-2 through which the connector protrusions 29 and contactor 30 may extend to permit the making of electrical contact of contactors 30 and 32 (see FIGS. 6 and 7).

The connector protrusions 29 are preferably held in compression against the bottom sheet 26 by the frame top rib portions 21-5 which are positioned thereover and rods 21-2, heads 21-3 and insulator base support 34 (e.g., epoxy) holding the sheets 26, 27 and the spacer 33 closely together.

Figure 9:
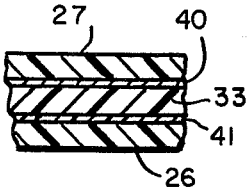
FIG. 9 is a sectional view greatly enlarged taken along line 9—9 in FIG. 1 showing adhesive being used to hold the layers together.
Figure 7:
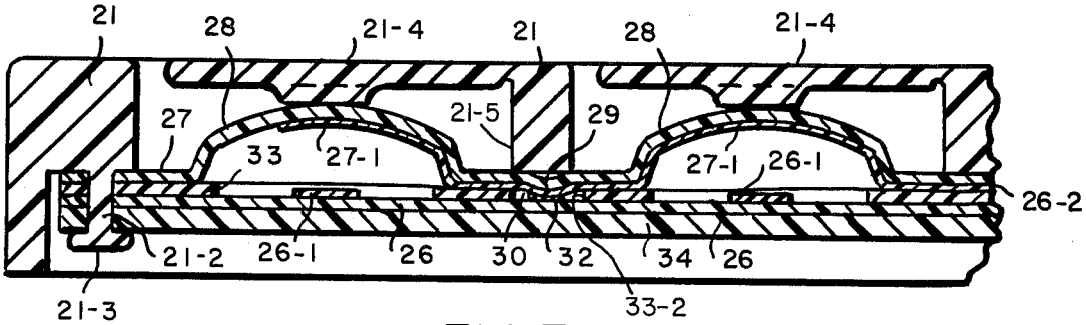
FIG. 7 is a sectional view greatly enlarged taken along line 7—7 in FIG. 1.

In this manner good electrical contact is made between the contacting material supported by the protrusions and the contacts 26-1. The sheets 26 and 27 and spacer are also preferably held together by adhesive layers as shown in FIG. 9 at 40 and 41 in addition to the frame structure as shown to insure good contact.

In some cases depending upon the depth of protrusion the adhesive such as epoxy, etc., may be used in lieu of the frame portions to effect good contact.

It should be understood that the top sheet 27 need not include domes and may be constructed as a flat sheet having the connector protrusions 29.

I claim:

1. A keyboard comprising a first sheet of flexible and resilient insulator plastic, a first circuit pattern supported on the underside of said sheet, said first circuit pattern having contactors and circuit lines of electrically conductive material, said circuit lines selectively coupled to said contactors, a first plurality of snappable convex domes and at least one concave dome formed in said first sheet, each dome supporting a contactor of said first circuit pattern, an insulator spacer having a plurality of openings in register with said concave and convex domes and of a size to selectively permit the domes to extend into said openings, a second sheet of insulator plastic supporting a second circuit pattern, said second circuit pattern having contacts and circuit lines of electrically conductive material, said circuit lines selectively coupled to said contacts in register with said openings, and means for continuously holding said first sheet, spacer and second sheet together whereby said concave dome extends into said spacer opening in register therewith and said contactor supported thereby is urged against a contact of said second circuit pattern in register therewith, said first circuit pattern contactors supported by said convex domes capable of being snapped into said spacer openings to selectively engage other contacts of said second circuit pattern by depression of said convex domes, said contactors of said first circuit pattern being supported on the interior of said convex domes and on the exterior of said at least one concave dome, and at least the contactor supported by said at least one concave dome being interconnected by a circuit line to a contactor supported by at least one of said convex domes.

2. The keyboard of claim 1 in which said means for holding comprises a frame for said keyboard.

3. The keyboard of claim 2 in which said means for holding also comprises adhesive.

4. The keyboard of claim 1 in which said means for holding comprises adhesive.

5. The keyboard of claim 1 in which each of said concave dome is compressed.

6. The keyboard of claim 1 in which said first sheet comprises convex and concave domes, each supporting portions of said first circuit pattern, said first sheet being flexible and resilient and said first circuit pattern supported thereby being flexible.

7. The keyboard of claim 1 in which the concave domes comprise at least two in number.

8. The keyboard of claim 1 in which there is provided a frame as part of the keyboard and actuators positioned by the frame for depressing the convex domes.

* * * * *